United States Patent [19]

Demny et al.

[11] 4,430,875

[45] Feb. 14, 1984

[54] ROLLING MILL FOR THE STRETCH-REDUCING OF TUBES

[75] Inventors: Werner Demny, Düsseldorf; Hermann Möltner, Grevenbroich; Hans-Dieter Gerhards, Solingen-Gräfrath, all of Fed. Rep. of Germany

[73] Assignee: Kocks Technik GmbH & Co., Hilden, Fed. Rep. of Germany

[21] Appl. No.: 276,023

[22] Filed: Jun. 22, 1981

[30] Foreign Application Priority Data

Jul. 25, 1980 [DE] Fed. Rep. of Germany ..... 3028211

[51] Int. Cl.[3] ..... B21B 39/08

[52] U.S. Cl. ..... 72/205; 72/249; 72/367

[58] Field of Search ..... 72/199, 205, 234, 249, 72/366, 367, 443

[56] References Cited

U.S. PATENT DOCUMENTS 3,645,121 2/1972 Pfeiffer et al. ..... 72/205

4,020,667 5/1977 Demny et al. ..... 72/205

4,306,440 12/1981 Demny ..... 72/205

*Primary Examiner*—Francis S. Husar

*Assistant Examiner*—Jonathan L. Scherer

*Attorney, Agent, or Firm*—Buell, Blenko, Ziesenheim & Beck

[57] ABSTRACT

In a method of rolling tubes in a stretch-reducing rolling mill having a group drive in which the elongation, and therefore the tension is increased by increasing the speed of an auxiliary drive motor relative to that of a main drive motor, the length of the trailing "thickened end", which must be rejected as scrap, is reduced by increasing the elongation from the point in time at which the start of the trailing end portion of the tube reaches the last stand. This trailing end portion is that portion which receives a larger wall thickness than the central portion of the tube as a result of the reduced tension exerted in the trailing end portion of prior art practices. The start of this trailing end portion can be predicted from experience or by rolling a sample tube without subjecting its trailing end portion to the said increased elongation and measuring the wall thickness at the trailing end portion of the sample tube.

5 Claims, 1 Drawing Figure

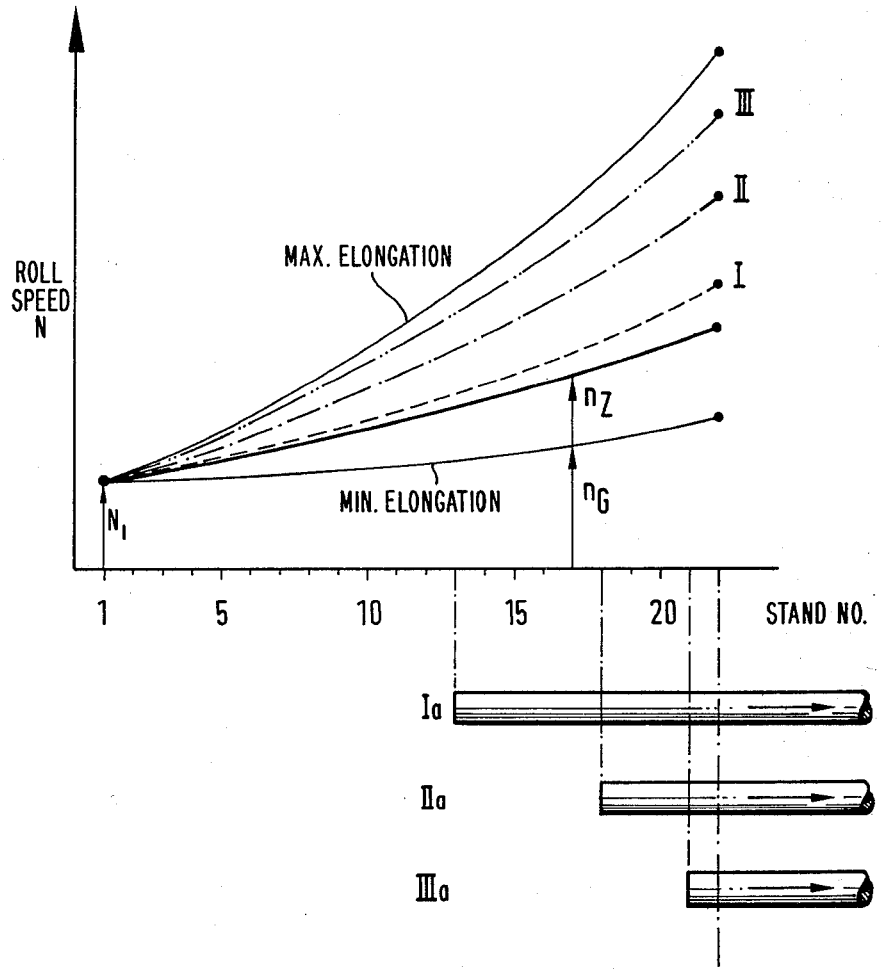
ROLL SPEED N
MAX. ELONGATION
MIN. ELONGATION
III
II
I
$n_Z$
$n_G$
$N_1$
1
5
10
15
20
STAND NO.
Ia
IIa
IIIa

ROLLING MILL FOR THE STRETCH-REDUCING OF TUBES

This invention relates to rolling mills for stretch-reducing of tubes and methods of operating such mills and particularly to a method of operating a rolling mill for the stretch-reducing of tubes, having a large number of rolling stands which are disposed closely one after the other, in which the rotational speeds of the rolls of the stands are changed during the passing-through of the trailing end portions of the tube relative to the rotational speeds of the rolls during the passing-through of the central portions of the sections of tube.

When stretch-reducing tubes, in which the wall thickness and the external diameter of the tube are reduced, portions of appreciable length having wall thickness larger than that of the central portion of the tube are formed adjoining the leading and trailing ends of a rolled tube. The two end portions having wall thicknesses exceeding the admissible tolerance have to be severed from each tube and can generally only be used as scrap. These sections designated "thickened ends" are a result of the rolling method. They are formed by virtue of the fact that, in order to obtain a predetermined reduction in the wall thickness of the finished tube, a predetermined amount of tension also has to be exerted on the tube during the rolling operation and, although this tension is obtained in the region of the central section of the tube, it is not obtained in the required manner at the leading and trailing end portions of each tube. It is desirable to keep these thickened ends as short as possible for reasons of economy. The inability to control these thickened end portions of stretch-reduced tubing has been a long continuing and well known problem in stretch-reducing mills.

In a known type of construction, as described in British Pat. No. 1278630, when the rolling mill is filled, that is to say, when rolling the central sections of tubes, the rotational speeds of the rolls of all the stands are reduced directly before the trailing end portions of the tubes enter the first rolling stand, the rotational speeds being reduced by the same percentage amount. Upon the entry of the trailing end portions of the tubes, the reduced rotational speeds are increased again in dependence upon the length of the entry travel of the end portions of the tubes into the rolling stands disposed at the entry end, such that the percentage reduction of rotational speed decreases with increasing length of the entry travel of the trailing end portions of the tubes into the rolling mill. This operation is effected in the region of the stands at the entry end, such as the first eleven stands, the trailing end portions of the tubes being subjected to an increased, even though still inadequate, tension which only shortens the trailing thickened ends to a certain extent.

This known type of construction has the disadvantage that it can only be effected in the case of individually driven stands. These stands in turn render it difficult to maintain the predetermined rotational speeds constant during the steady operating state, that is to say, when the leading end portion of the tube is already beyond the delivery end of the rolling mill and the trailing end portion of the tube has not yet reached the entry end of the rolling mill. Furthermore, individually driven stands with their control and regulating devices are very costly, and the drive is prone to trouble. A further disadvantage resides in the fact that the trailing end portion of the tube in the delivery end portion of the rolling mill, for example from the twelfth rolling stand onwards, is no longer subjected to increased tension which could shorten the lengths of the trailing thickened ends.

In another known type of construction, as described in British Pat. No. 1487614, the trailing end portions of the tubes are subjected, in the same manner as the leading ends of the tubes, to a significantly greater tension upon passing through the rolling stands which build up tension at the entry end where tension in the tube is built up in the steady operating state, this greater tension being applied by fully utilizing the transmission capablility of the frictional forces between rolls and tube and thus exerting the maximum possible tension on the trailing end portions of the tubes. Thus, the thickened ends are kept significantly shorter than in the first mentioned known type of construction and, moreover, the second type of construction which has been mentioned can be realized in rolling mills having a group drive as well as in rolling mills having a single drive, so that one does not have to have recourse to the expensive individual drives. The thickened ends, at both leading and trailing ends of the tube are, however, still undesirably long and wasteful.

An object of the present invention is to further shorten the lengths of the thickened ends of the tube.

In accordance with the invention, there is provided a method of operating a rolling mill for the stretch-reducing of tubes, having a large number of rolling stands which are disposed closely one after the other in which, from the entry or predicted entry of the start of a trailing end portion of each of the tubes into the last rolling stand at the delivery end onwards, the elongation effected by the rolling mill is increased relative to the elongation effected during rolling of the central portion of the tube, this increase in the elongation being effected by changing the rotational speeds of the rolls of the stands during the passing-through of the trailing end portions of the tubes, relative to the rotational speeds of the rolls during the passing-through of the central portions of the tubes as a function of the increase or predicted increase of the tube wall thickness of such trailing end portions of the tube towards the tube ends.

The said trailing end portions of the tubes are those portions which receive a larger wall thickness than the central portions of the tube as a result of insufficient tension being developed in such trailing end portions as they pass through the mill up to the point or predicted point at which the start of such trailing end portion reaches the last stand. By increasing the stand-to-stand roll speed ratios from this point onwards as a function of the increase in tube wall thickness, the tension in the trailing end portions can be raised in order to further elongate the trailing end portions up to the instant at which the trailing end of the tube leaves the next-to-last stand. The length of the so called "thickened ends" is thereby reduced, i.e. to a value less than the length of the said trailing end portions.

In the case of a group drive in which, at each stand of the group, an auxiliary speed derived from a common auxiliary motor is superimposed on a main speed derived from the common main motor, the tension can be raised in the trailing end portions by increasing the speed of the auxiliary motor or by decreasing the speed of the main motor or by both of these measures.

Irrespective of the measures which are taken in the region of the rolling stands disposed at the entry end of the rolling mill in order to shorten the thickened trailing ends of the tubes, the trailing end portions of the tubes are thereby additionally subjected again to an increased tension in the region of the rolling stands at the delivery end, the thickened ends are thereby shortened. It will be appreciated that it is also possible only to make use of the proposal in accordance with the invention, that it is to say, to dispense with measures at the entry portion of the rolling mill, as described in British Pat. No. 1487614, although this is less advisable.

It is readily possible to use a group drive, to subject, in accordance with the invention, the predicted trailing end portions of the tubes to increased tension in the delivery portion of the rolling mill and, even in the case of a rolling mill having a single drive, it is not even necessary to supply power to the various motors individually, and the less expensive group control can be used. Thus, the trailing thickened ends of the tubes can be further shortened to a considerable extent with only a small amount of additional expenditure. This involves, particularly in the case of the group drive, only the devices which are necessary to detect the trailing ends of the tubes for the purpose of commencing the changes of elongation at the correct point in time, and the device which controls the change of elongation as a function of the wall thickness of the tubes. That is to say, it is essential to commence the increase of elongation precisely when the start of the trailing end portion of a tube enters the last rolling stand, that is to say, only the trailing end portion of the tube just rolled is located in the rolling mill. The length of this trailing end portion of the tube depends upon the cross-sectional area reduction of the tube wall in the rolling mill, that is to say, it is dependent upon the difference between the incoming tube and the finished tube. The lengths which the thickened ends would have in the absence of the present invention can be predicted from experience or empirically by rolling a sample tube without the change of elongation which would be achieved in accordance with the invention, that is to say, the entire tube is rolled with only the elongation with which the central portions of the sections of tube are normally rolled, the length of the trailing thickened end so produced then being measured. The length, and thus the starts of the trailing end portions of the tubes can be accurately predicted by means of this sample tube, and the location of the trailing end of the tube in the rolling mill at which the increase in elongation is to be initiated can then be determined. The increase in the wall thickness of the trailing end portion of the tube can be determined empirically using the same method, i.e. by measuring the thickness of the trailing end portion of the rolled sample tube at various points along its length. The magnitude of the increase in elongation of the trailing end portions of the tubes required when carrying out the invention can then be established, since the required increase is a function of the increase in thickness.

In a preferred embodiment of the invention, the increased elongation is again decreased, after the trailing ends of the tubes have been delivered from the last but one rolling stand at the delivery end, to the value used when rolling the central portions of the tube. The possiblility of subjecting the tubes to tension terminates when the trailing ends of the tubes are delivered from the last stand but one, and it is important to prepare the rolling mill as rapidly as possible for rolling the following tube. For this purpose, upon reducing the increased elongation, it is advisable that the elongation value prevailing during rolling of the central portions of the tube should be reached again when the entire thickened leading end portion of the following tube has passed through the last of those rolling stands which build up tension at the entry end. In this manner, when using the invention, it is also possible to maintain a short distance between successive tubes.

In the case of a rolling mill in which the rolling stands are driven by a group drive having a main motor and an auxiliary motor, it is advisable to vary the elongation by varying the rotational speed of the auxiliary motor. By way of example, this change of elongation is performed in the same manner as in the case of a change of rolling programme. The corresponding devices for this purpose already exist in rolling mills of this kind. However, a novel feature is the use of this possibility of adjusting the elongation also for the purpose of acting upon the trailing end portions of the tubes at the delivery end portion of the stretch-reducing mill. The same effect can, of course, also be achieved by maintaining the rotational speed of the auxiliary motor constant and varying the rotational speed of the main motor holder. When increasing the elongation only by means of the main motor, it is necessary to reduce the rotational speed of the main motor in contrast to the first-mentioned control solely by means of the auxiliary motor which has to be driven at an increased rotational speed when increasing the elongation. It is even conceivable to vary the rotational speeds of the main motor and the auxiliary motor simultaneously. The rotational speed of one motor then has to be reduced and the rotational speed of the other motor has to be increased.

The invention is further described, by way of example, with reference to the accompanying drawing, which is a graph in which the roller speeds are plotted for individual stands to achieve various elongations.

The stretch-reducing rolling mill (not illustrated) under consideration has, for example, twenty-two stands which are indicated by number along the abscissa. The ordinate symbolizes the rotational speeds of the rolls increasing upwardly. Specific revolutions per minute are not stipulated, since they can vary to a considerable extent for individual rolling mills and dimensions of tubes. It is assumed in the graph that the rolls of all the stands are of the same diameter.

One of the illustrated curves is shown by a heavy solid line and produces, by way of example, the elongation which exists in the steady operating state without using the invention, that is to say, when a central portion of a tube is being rolled and the leading end portion of the tube is already beyond the rolling mill and the predicted trailing end portion of the tube has not yet reached the rolling mill. The rotational speeds N of the rolls are obtained by rotation by means of differential gears namely from a basic rotational speed $n_G$ produced by the main motor and main gear train, and an auxiliary rotational speed $n_Z$ produced by the auxiliary motor and an auxiliary gear train. The two respective rotational speeds are added up separately for each stand as is shown by the arrows in the case of stand 17. The auxiliary rotational speeds $n_Z$ of all the stands can be varied simultaneously within predetermined limits by a corresponding control of the auxiliary motor, so that the minimum elongation is effectd at an auxiliary rotational speed of 0, that is to say, when the auxiliary motor is not running, and the maximum elongation is effected at the highest possible auxiliary rotational speed. The curves of these two limiting values are shown by thin solid lines. The gear ratios of the main and auxiliary gear trains are different from one another so that the speed $N_1$ of stand 1 is substantially independent of the auxiliary motor speed and the speeds $N_k$ of the succeeding stands become progressively more influenced by the auxiliary speed $n_Z$ and thereby by the auxiliary motor speed. Consequently, for a given main motor speed, the elongation is increased with increasing auxiliary motor speed.

As soon as the start of the trailing end portion of the tube (which is thickened because it has not up to now been subjected to the desired tension and which would be delivered as a thickened end from the rolling mill if the latter were to operate exclusively in accordance with the curve shown by a thick solid line) enters the last rolling stand (the twenty-second in the illustrated embodiment), the trailing end of the tube is located in, for example, the 13th stand (as is indicated under the numeral Ia), depending on the predicted length of the said trailing end portion. A sensor device (not illustrated) senses the trailing end of the tube, preferably before the latter has reached the entry end of the mill, and the progress of this trailing end into and through the mill can be estimated, taking into account the predicted elongation in the mill. When it is estimated that the start of the said trailing end portion has reached the last stand, as indicated at Ia, the elongation is increased by increasing the rotational speed of the auxiliary motor, thus resulting in the roller being driven at speeds in accordance with the curve which is designated I and which is shown by a broken line in the graph, and thus in increased elongation which is manifested by greater tension in the trailing end portions of the tubes. The further the extent to which a trailing end portion of a tube is delivered from the rolling mill, the greater the increase in the elongation which is effected and thus of the tension, which is shown by the position of the tube shown under numeral IIa and by the dash-dot elongation curve III. It will be appreciated that an entire series of curves exists between the curves I and II, and this also applies in the same manner to the region between the curves II and III.

Curve III shows the maximum elongation adjustment which occurs in the illustrated embodiment. This is attained when a trailing end portion of a tube is only located in the last but one and last rolling stands as at IIIa. Since the wall thickening is at a maximum in the region of the end of the tube, operation must also be effected with the maximum additional elongation adjustment during passing-through of the trailing end of the tube. As is clearly shown in the graph, the elongation adjustment increases towards the trailing end of the tube, which corresponds to the increase in the wall thickness. The greater the extent to which the wall thickens towards the end of the tube, the more rapid must be the increase in the elongation and thus the increase in the auxiliary speeds $n_Z$. It is quite possible that the maximum elongation corresponding to curve III will not lie below the maximum possible elongation adjustment of the rolling mill as illustrated, and will be identical with this uppermost curve which shows the maximum possible elongation by the rolling mill.

In the foregoing specification we have set out certain preferred practices and embodiments of this invention. It will, however, be understood that this invention may be otherwise embodied within the scope of the following claims.

We claim:

1. In a method of operating a rolling mill for the stretch-reducing of tubes, having a large number of rolling stands which are disposed closely one after the other so as to substantially reduce thickened trailing ends on such tubes, the step of increasing the elongation effected by the rolling mill relative to the elongation effected during rolling of the central portion of the tube from the entry or predicted entry of the start of a trailing end portion of each of the tubes into the last rolling stand at the delivery end onwards, said increase in the elongation being effected by changing the rotational speeds of the rolls of the stands during the passing-through of the trailing end portions of the tubes, relative to the rotational speeds of the rolls during the passing-through of the central portions of the tubes, as a function of one of the increase and predicted increase of the tube wall thickness of such trailing end portions of the tube towards the tube ends.

2. A method of operating a rolling mill as claimed in claim 1, in which the increased elongation is reduced to the value prevailing when rolling the central portions of the sections of tube, after the trailing ends of the tubes have been delivered from the last but one rolling stand at the delivery end of said rolling mill.

3. A method of operating a rolling mill as claimed in claim 2, in which the elongation value prevailing during rolling of the central portions of the tubes is reached again when the entire thickened leading end portion of the following tube has passed through the last one of those rolling stands which build up tension in the tubes at the entry end.

4. A method of operating a rolling mill as claimed in claims 1, 2 or 3, in which the rolling stands are driven by a group drive having a main motor and an auxiliary motor, and in which the elongation is varied by varying the rotational speed of at least the auxiliary motor.

5. In a method of operating a rolling mill for stretch-reducing of tubes having a plurality of roll stands disposed closely one after another, the step of:

a. changing the relative rotation speed of successive roll stands from that prevailing during the rolling of the central portion of a tube during the period when the trailing end portion enters the last rolling stand at the delivery end until the said trailing end has been passed through one of the last and last but one of the roll stands at the delivery end, as a function of the increase of the wall thickness of said trailing end as it enters the last stand of the rolling mill, whereby to increase the elongation effected by the rolling mill relative to that effected during the rolling of the central portion of the tube.

* * * * *